US007775014B2

(12) United States Patent
Karlström et al.

(10) Patent No.: US 7,775,014 B2
(45) Date of Patent: Aug. 17, 2010

(54) METHOD AND ARRANGEMENT FOR STUDSYSTEM

(76) Inventors: Johan Tore Karlström, Vikingagränd-6, FIN-22150, Jomala (FI); Johan Mikael Karlström, Skarpansvagen 27 C 7, FIN-22100, Mariehamn (FI)

( * ) Notice: Subject to any disclaimer, the term of this patent is extended or adjusted under 35 U.S.C. 154(b) by 745 days.

(21) Appl. No.: 10/312,575

(22) PCT Filed: Jul. 26, 2001

(86) PCT No.: PCT/FI01/00683

§ 371 (c)(1),
(2), (4) Date: Jun. 30, 2003

(87) PCT Pub. No.: WO02/10523

PCT Pub. Date: Feb. 7, 2002

(65) Prior Publication Data

US 2004/0010996 A1 Jan. 22, 2004

(30) Foreign Application Priority Data

Jul. 27, 2000 (FI) ..... 20001715

(51) Int. Cl.
*E04C 3/00* (2006.01)

(52) U.S. Cl. ..... 52/841; 52/844; 52/845

(58) Field of Classification Search ..... 52/729.2, 52/729.4, 730.1, 730.7, 731.3, 731.5, 732.2, 52/733.2, 404.3, 404.4, 407.3, 841, 844, 52/852; 144/354

See application file for complete search history.

(56) References Cited

U.S. PATENT DOCUMENTS 2,169,253 A * 8/1939 Kotrbaty ..... 52/693

(Continued)

FOREIGN PATENT DOCUMENTS

DE 1970345 7/1998

(Continued)

OTHER PUBLICATIONS

German Utility Model No. G90 12 616.5, filed Sep. 4, 1990 and published on Dec. 20, 1990, "A kit for producing wooden supporting structures".

(Continued)

*Primary Examiner*—Richard E Chilcot, Jr.
*Assistant Examiner*—Elizabeth A Plummer
(74) *Attorney, Agent, or Firm*—Arent Fox LLP

(57) ABSTRACT

The present invention relates to a method for attaching a first stud (20) against a transverse second stud (30). The respective stud(s) include(s) at least two opposite flanges (5). A connector piece (40) is brought to extend at said first stud (20) into a longitudinal groove which is arranged at a flange inner side (6), whereby an outer locking end (42) arranged at said connector piece is brought into a locking engagement with a corresponding groove (12) in the other stud (30). The present invention also relates to a stud (20, 30) which includes opposite flanges (5) and a first longitudinal groove between said flanges. An additional longitudinal groove (12) extends in into the respective flange (5) and defines a retaining edge (14) for a connector piece (40) which extends in the groove. The present invention further relates to a connector piece (40) for connecting studs (20, 30). The connector piece (40) includes side portions (43, 44, 45) which in an engaging manner are enclosed by a groove (12) in the respective stud (20, 30).

4 Claims, 6 Drawing Sheets

U.S. PATENT DOCUMENTS

Figure 1:
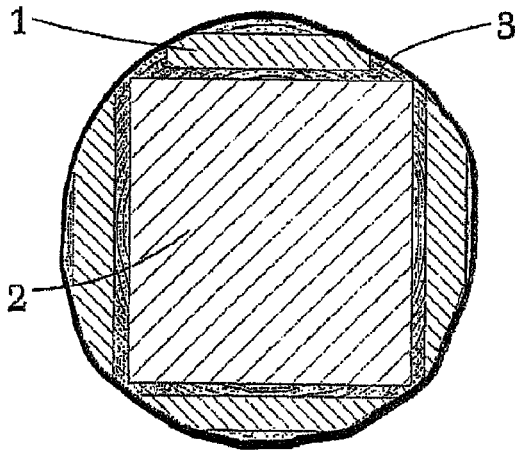

| | | | | | |
|---|---|---|---|---|---|
| 3,170,201 | A | * | 2/1965 | Nofziger | 52/732.2 |
| 3,960,637 | A | * | 6/1976 | Ostrow | 156/293 |
| 4,074,498 | A | * | 2/1978 | Keller et al. | 52/690 |
| 4,191,000 | A | * | 3/1980 | Henderson | 52/729.4 |
| 4,195,462 | A | * | 4/1980 | Keller et al. | 52/690 |
| 4,336,678 | A | * | 6/1982 | Peters | 52/729.4 |
| 4,464,074 | A | * | 8/1984 | Green et al. | 403/192 |
| 4,967,534 | A | * | 11/1990 | Lines | 52/729.4 |
| 4,974,389 | A | * | 12/1990 | Onysko et al. | 52/729.4 |
| 5,114,265 | A | * | 5/1992 | Grisley | 403/381 |
| 5,210,990 | A | | 5/1993 | Kirk, Jr. | |
| 5,267,425 | A | * | 12/1993 | Onysko et al. | 52/729.2 |
| 5,323,584 | A | * | 6/1994 | Scarlett | 52/729.4 |
| 5,325,651 | A | * | 7/1994 | Meyer et al. | 52/715 |
| 5,625,995 | A | * | 5/1997 | Martin | 52/715 |
| 5,653,080 | A | * | 8/1997 | Bergeron | 52/729.4 |
| 5,664,393 | A | * | 9/1997 | Veilleux et al. | 52/729.4 |
| 5,761,872 | A | * | 6/1998 | Sanford et al. | 52/694 |
| 5,875,604 | A | * | 3/1999 | Rudd | 52/731.8 |
| 5,953,876 | A | * | 9/1999 | Agar | 52/489.1 |
| 5,966,894 | A | * | 10/1999 | Crump, Jr. | 52/729.4 |
| 6,173,550 | B1 | * | 1/2001 | Tingley | 52/729.1 |
| 6,318,046 | B1 | * | 11/2001 | Horsfield et al. | 52/730.7 |
| 6,357,194 | B1 | * | 3/2002 | Jones, Jr. | 52/590.1 |
| 6,460,310 | B1 | * | 10/2002 | Ford et al. | 52/729.1 |
| 6,519,908 | B1 | * | 2/2003 | Masterson et al. | 52/696 |
| 6,701,690 | B2 | * | 3/2004 | Deschenes | 52/729.4 |

FOREIGN PATENT DOCUMENTS

| | | | |
|---|---|---|---|
| DE | 19700345 | A1 | 7/1998 |
| FR | 1 247 794 | | 10/1960 |
| GB | 1605134 | | 1/1982 |
| WO | 9104379 | A1 | 4/1991 |
| WO | WO 9100437 | A1 | 4/1991 |

OTHER PUBLICATIONS

German Utility Model No. DE G 91 07 760.5, filed on Jun. 24, 1991 and published on Oct. 22, 1992, "Roof beam and framework".

* cited by examiner

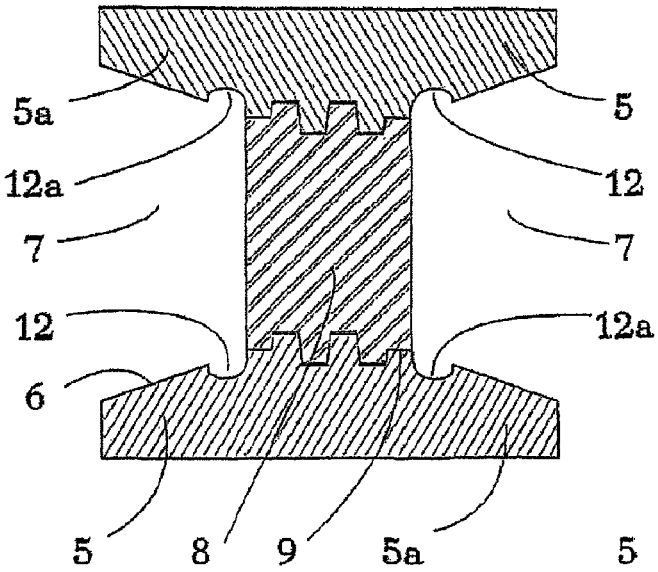
Fig 10a
Fig 10b
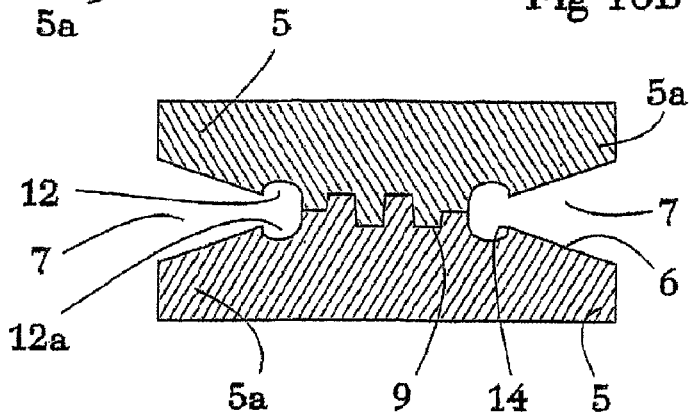
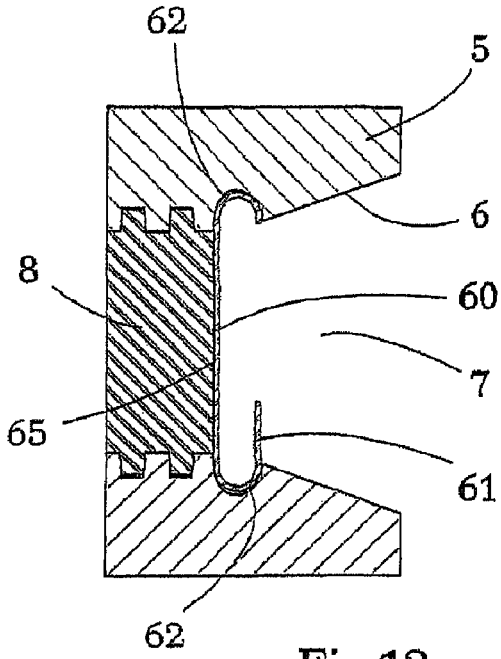
Fig 12
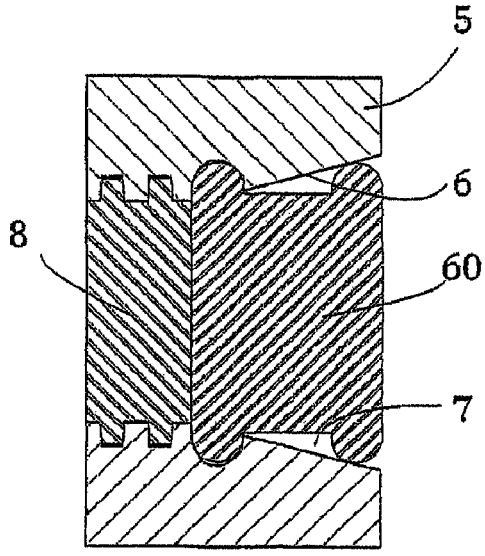
Fig 13

METHOD AND ARRANGEMENT FOR STUDSYSTEM

CROSS-REFERENCE TO RELATED APPLICATION

This application is a National Stage entry of International Application No. PCT/FI01/00683, filed Jul. 26, 2001, the entire specification claims and drawings of which are incorporated herewith by reference.

The present invention relates to stud arrangements and stud related methods in accordance with the preamble of the respective appended independent claim. Especially, the present invention relates to a stud arrangement including studs which have respectively opposite flanges as well as separate connector pieces for mutually interconnecting said studs, and further a stud including respective opposite flanges and a first longitudinal groove which extends inwards between said flanges. The present invention also relates to a connector piece for interconnecting studs having opposite longitudinal flanges, and further to methods related to studs, especially a method for attaching a first stud against a second stud which is arranged transversely in relation to said first stud, wherein said first stud includes at least two opposite flanges and said second stud is shaped, in a cross section, in the same or in a much similar manner. The present invention further relates to a method for establishing a connection between a stud and some other building structure, suitably a second essentially similar stud, wherein said stud includes at least two opposite flanges and a longitudinal first groove which extends between said flanges, the depth of said first groove being less than a corresponding height in the ross section of the stud.

Prior art knows different stud systems made of relatively thin sheet metal, wherein studs usually are shaped to have a generally U-shaped cross section. Such studs are utilized especially for constituting frame structures for partitional walls and the like structures, where wall panels based on, e.g., waste wood or especially gypsum are attached, for example by screwing, to the flanges of the vertically erected studs. Such studs are usually attached essentially vertically between corresponding horizontal studs which are arranged at the floor and, respectively, the ceiling in a space where the partitional wall will be erected. In such a case the scarce goods thickness of the metal studs render no essential dimensional problems where overlapping flange portions occur at the interconnections between the vertical and the horizontal studs. Metal studs, however, cause some other problems which have been discussed in more detail elsewhere, and instead it has been proposed that corresponding studs could be made of, for example, wood.

In connection with such studs the greater goods thickness usually prevents the use of overlaps and thus it is appropriate to make the interconnection between vertical and horizontal studs without such an overlapping. Thus, the present application relates to stud arrangements and stud related methods where the studs are made of wood or some other material at which the stud flange thickness usually cannot be neglected.

One object of the present invention is to provide an arrangement which renders possible a steady and quick erecting of vertical studs in such a manner that each respective vertical stud will connect to at least one horizontal stud, usually between two such studs which are directed towards each other, i.e. a lower horizontal stud which usually is arranged at a floor or the like, as well as an upper horizontal stud which is arranged, e.g., at a ceiling. The arrangement is suitably such that at least said horizontal studs also can be self-supporting, i.e. not attached to any horizontal structure, in which case the stud arrangement in accordance with the present invention also can find a use as, for example, semi-high partitional walls which do not reach all the way up to a ceiling, as well as, respectively, as a terminating lower stud in openings or the like.

One object of the present invention is further to disclose a stud arrangement where the attachment between vertical and horizontal studs is effected by means of common carpenter's tools and without any other special assisting arrangements.

One object of the present invention is also to disclose an arrangement which during the erecting work and thereafter permits a certain fine adjustment, i.e. usually a horizontal displacement of the vertical studs without essentially affecting the strength of the attachment.

One further object of the present invention is to provide a stud arrangement in which all stud parts can be of essentially the same cross section, suitably identical so that one single stud profile can be used both as a horizontal stud as well as as a vertical stud, favorably so that also shortish stud stumps can be utilized and so that a final longitudinal adaptation of the vertical studs can be made at the actual erecting and where a certain clearance between vertical and horizontal studs can be accepted.

One further object of the present invention is also to propose an arrangement in which the erecting of the vertical studs can be effected while standing on the floor and favorably any number of times without the risk that any stud erroneously would twist free or be displaced.

These objects and other advantages are reached in a stud arrangement as well as in methods in accordance with the characteristic features which are presented in each respective appended independent claim. Thus, a stud according to the present invention is characterized in that each respective flange includes at least one further longitudinal groove which extends from the first groove, where said first groove generally is defined by the space between the respective flanges, in into each respective flange in such a manner that said groove defines a retaining edge, at the mutually facing inner sides of each respective flange, for keeping a separate connector piece which extends in said groove.

Again, in accordance with the present invention a stud system including connector pieces is characterized in that each respective connector piece is arranged for co-operation with at least one longitudinal groove which is formed in each respective stud in the direction of the stud, which groove is arranged for preventing a movement of said connector piece in a direction away from said stud in a transverse direction in relation to the stud's longitudinal direction. Again, a connector piece according to the present invention is characterized in that said connector piece favorably is an essentially elongated piece which includes opposite side portions which are arranged to be partially enclosed, in an intermeshing manner, by at least one groove which is arranged in said opposite flanges to extend in the longitudinal direction of the respective stud.

The method for establishing a connection between a stud and some other building structure is characterized in that each respective flange is shaped to include, at an inner side thereof, which side is turned towards said first groove, respective opposite longitudinal second groove(s) for receiving, in a partially enclosing manner, at least one connector piece which is arranged to extend in said second groove(s). Again, the method for establishing a connection between studs is characterized in that a connector piece is brought to extend at said first stud in the longitudinal direction thereof in a longitudinal groove which is arranged at the respective inner side of the flange, and an outer locking end arranged at said connector piece is brought into a locking intermeshing position with respect to a groove which is formed, in a corresponding manner, in said second stud.

Figure 9A:
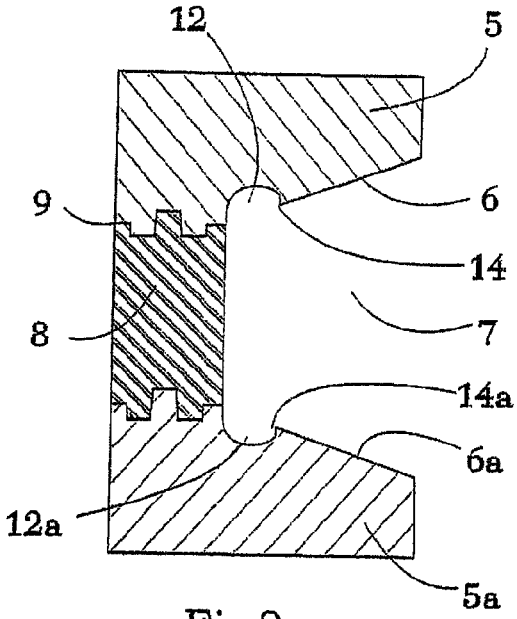
Figure 9B:
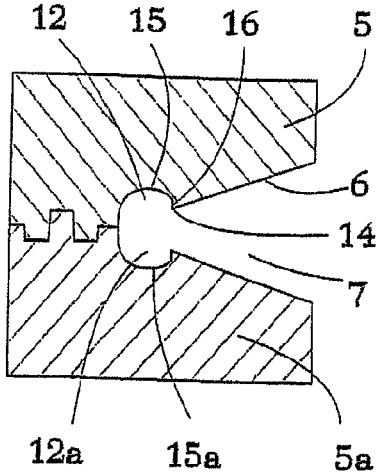

Hereafter some favorable embodiments of the present invention will be described in more detail as examples and with reference to the appended drawings, wherein FIG. 1 generally discloses a section of a round timber log from which a full edge timber block is sawed, while wane edge reject material suitably is used to form studs in accordance with the present invention, FIG. 2 in a perspective sectional view discloses an example of how a respective retrieval of material for studs can be effected, FIG. 3 in section discloses an example of a stud profile in accordance with an especially favorably embodiment of the present invention, FIGS. 4*a* and 4*b* disclose examples of studs which have been shaped to include a stud profile having a general cross section which corresponds to that which is disclosed in FIG. 3, FIG. 5 discloses an attachment between a vertical stud and an upper horizontal stud by utilizing a separate connector piece in accordance with the present invention, wherein only the uppermost part of the vertical stud is disclosed in order to better show the design and position of the connector piece in the additional groove in accordance with the present invention, FIG. 6 discloses a cross section of the connector piece at line A-A according to FIG. 5, FIG. 7 discloses arrangements at the manufacture of the flange portions for a stud in accordance with one embodiment of the present invention, FIG. 8 generally discloses the structure of a stud which has a slightly different profilation in accorance with another embodiment of the present invention, FIGS. 9*a* and 9*b* disclose different studs which have been manufactured of the same flange element(s), where the stud according to FIG. 9*b* lacks an intermediate web, FIGS. 10*a* and 10*b* in a corresponding manner disclose studs having a different cross section, FIG. 11 in a perspective view discloses a parallel connection of studs according to a special embodiment of the present invention, FIG. 12 in section discloses a special profile for a connector piece, and FIG. 13 in section discloses an alternative profile for a connector piece.

Figure 2:
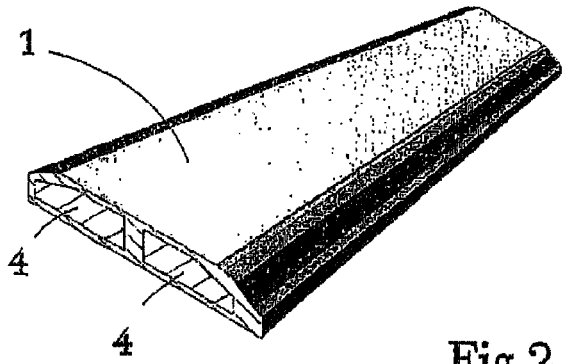

Referring to FIG. 1 studs in accordance with the present invention are manufactured in an appropriate manner of excess wood material which is retrieved from the wane edge outside boards 1 which are formed when full edge timber blocks 2 are sawed out of round timber logs 3. From such outside boards 1 stud flange material blocks 4 are favorably taken out as disclosed in FIG. 2. The flanges in each respective stud are then formed, favorably, from said material block 4 in a manner which is disclosed in more detail with reference to FIG. 7.

Figure 3:
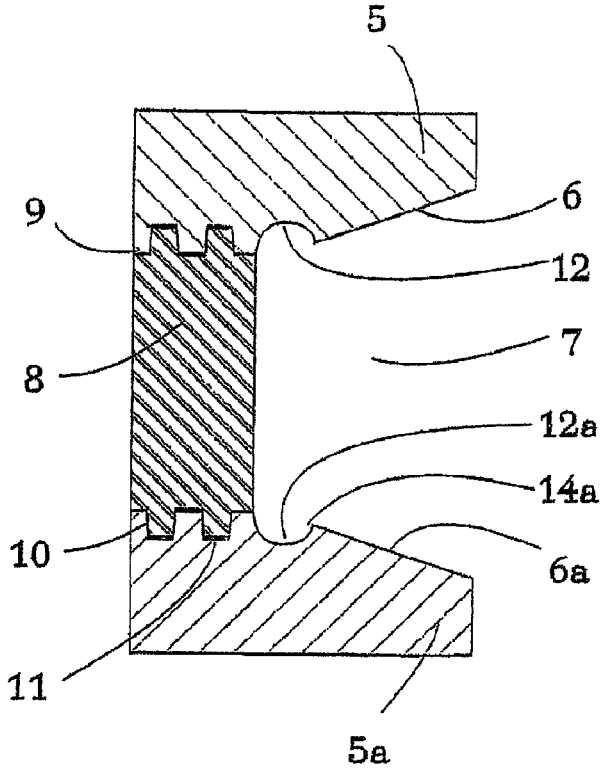
Figure 4A:
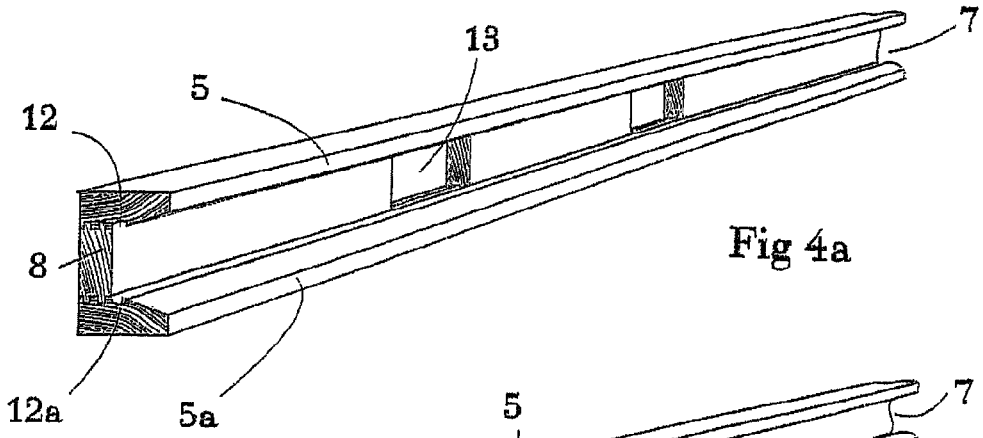

A stud according to an especially favorable embodiment of the present invention includes a cross sectional profile which has the general shape as disclosed in FIG. 3. Such a stud includes opposite elongated flanges 5, 5*a* which between themselves, especially between their inner sides 6, 6*a*, define a first longitudinally extending open groove which in the Figure generally is referred to as 7. In the embodiment which is disclosed in FIG. 3 the stud further includes a web 8 which is arranged between said flanges 5, 5*a*, while, for example, FIG. 9*b* discloses a stud including only said opposite flanges 5, 5*a*. Said flanges 5, 5*a* and said web 8 are interconnected along a contact surface 9 which suitably has a tongue-and-groove shape, and gluing is favorably used in order to provide an essentially monolithic structure. FIG. 3 then discloses that said tongues and grooves favorably are designed to have co-operating contact surfaces 10 which are inclined like a truncated wedge, and suitably so that a slit-like space 11 is formed at the end of each respective tongue for taking up any excess glue.

Studs which are generally shaped as disclosed above replace conventional metal studs but are both easier and more rigid to use. Until now, however, the attachment of vertical studs to more or less identical horizontal studs at ceilings and floors, for example, has been a difficult task, but this problem is solved, in accordance with the present invention, easily and in a secure manner by means of an additional groove 12, 12*a* which is arranged suitably in respective opposite flanges 5, 5*a*. This additional groove 12, 12*a* is favorably milled or planed at the same time when the flange material is formed, which is described in more detail with reference to FIGS. 7 and 8.

Figure 4B:
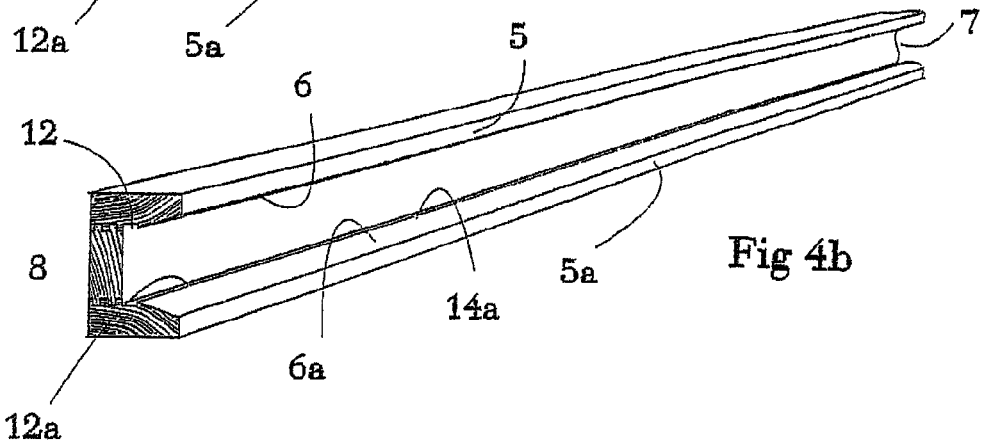

FIGS. 4*a* and 4*b* generally disclose examples of studs of the kind discussed above, where a stud according to FIG. 4*a* includes a web 8 which is constituted of shortish pieces, between which openings 13 are formed, which openings can be used as lead-throughs for, e.g., electrical installations. FIG. 4*b*, again, discloses an example of a stud which has a continuous web 8. Both Figures disclose said additional groove 12, 12*a* which suitably extends continuously over the stud's whole length and, at the same time, in a lateral direction in relation to said first longitudinal groove 7 which generally is constituted by the space between the mutually opposing inner sides 6, 6*a* of said flanges 5, 5*a*. Here FIG. 4*a* discloses a rounded groove profile 12, 12*a* which essentially corresponds to the groove profile which is disclosed in FIG. 9*a*, while FIG. 4*b* only as an example of a different embodiment discloses a groove profile 12, 12*a* which has an essentially rectangular cross section. These grooves 12, 12*a* extend from the inner surface 6, 6*a* of each respective flange 5, 5*a* in into the flange material, and said grooves 12 and 12*a*, respectively, at opposite flanges 5 and 5*a*, respectively, together constitute a bottom groove which suitably is located in the vicinity of the bottom of said first groove 7. The total width of said bottom groove, seen in a cross section of the stud, is at least at one location larger than the distance between at least one portion of the inner sides 6, 6*a* of said opposite flanges 5, 5*a*.

Favorably, said additional grooves 12, 12*a* are designed in such a manner that an intersection between said grooves and the respective inner flange side 6, 6*a* constitutes, at least at one side thereof, a clear retaining edge 14, 14*a* which at the attachment of the stud will have a barb-like function which is to be described later on. In the embodiment disclosed in FIG. 8 said retaining edge 14, 14*a* is constituted by the obtuse angle between a groove side 15, 15*a* and the corresponding inner flange side 6, 6*a*, but in an especially favorable embodiment, the details of which being disclosed in FIG. 9*b*, said retaining edge 14, 14 is shaped to constitute with the inner flange side 6, 6*a* an angle which in section is acute and which in its immediate vicinity suitably includes an essentially planar portion 16 which thereafter changes to the generally rounded groove side 15, 15*a* of said groove 12, 12*a*.

Figure 5:
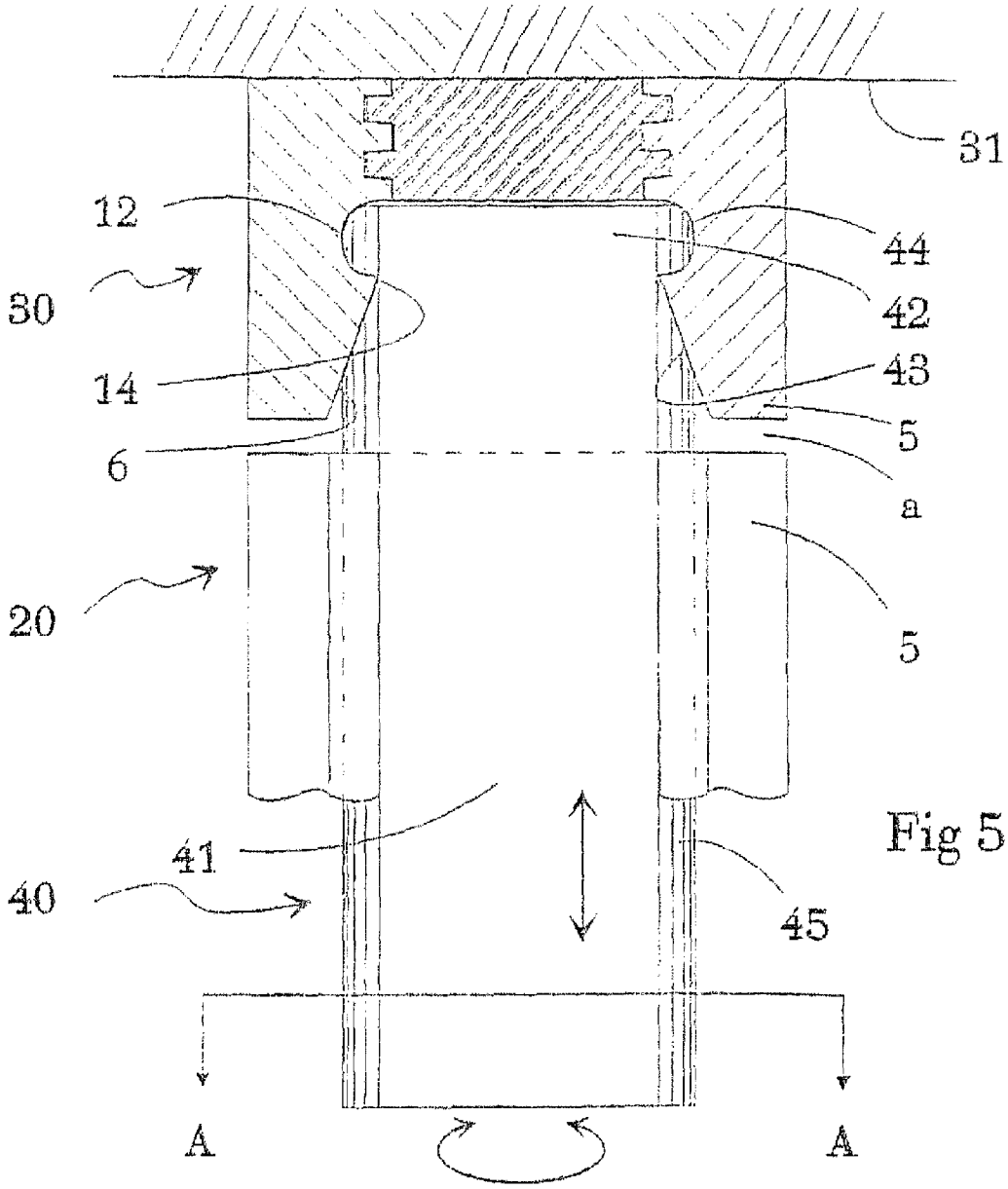
Figure 6:
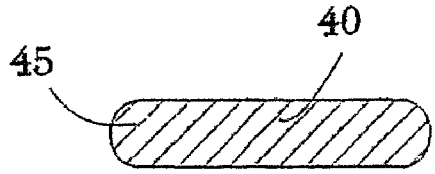

FIG. 5 discloses, in more detail, how said bottom groove constituted by said additional grooves 12, 12*a* is utilized in order to provide, in a mutually transverse direction, an attachment of one end of a first stud which in the Figure is referred to as 20, to, for example, a central field at a second stud which in a corresponding manner is referred to as 30. In this connection FIG. 5 is intended to provide an example mainly of the actual attachment, while the details of the different elements may vary, as such.

For the transverse attachment disclosed in FIG. 5 the present invention includes a separate connector piece which generally is referred to as 40. In a first direction, i.e. normally in the longitudinal direction said connector piece 40 has a cross sectional profile which generally corresponds to the bottom groove, which at the respective stud is formed by said additional groove 12, 12*a*, and by that portion of the groove 7 which lies between said additional grooves, where said groove 7 generally forms between said flanges 5, 5*a*, i.e. generally the open inner portion of a U-shaped cross section. FIG. 6 discloses, as an example, a cross section A-A for a connector piece 40 in a basic embodiment in accordance with FIG. 5 and adapted for use in connection with the stud profiles which are disclosed, e.g., in FIGS. 3, 4*a*, 4*b*, 5, 9*a*, 10*a*, which all comprise a broad rounded bottom groove. For the embodiment in accordance with FIG. 8 a corresponding profile cross section is angular, while in the embodiments according to FIGS. 9*b*, 10*b* and 11 the profile of the connector piece is narrower and in some embodiments has, e.g., the profile disclosed in FIG. 11.

The connector piece 40 is a separate piece which suitably is essentially freely movable, favorably in a slightly stiff manner, longitudinally in said bottom groove in the stud 20 whose end is to be connected to a transverse stud 30. At least one such connector piece 40, suitably a pair of them, is delivered in connection with each delivered vertical stud 20 and connector pieces 40 can also be delivered separately for use, e.g., for attaching or in some cases binding together stud stumps cut from full length studs. Since said additional grooves 12, 12*a* already for manufacturing reasons favorably extend along the stud's whole length one can, in practice, utilize the present invention for studs of almost any length. Thus, the general shape of said connector piece 40 includes a body portion 41 which generally extends in the stud's bottom groove. This portion has suitably an edge profile which generally corresponds to essential portions of the cross section profile of the bottom groove, and said portion 41 has such a length that a sufficient engagement, with respect to strength, is achieved between the connector piece 40 and the corresponding longitudinally extending stud 20 which cooperates with said connector piece in the longitudinal direction, as can be seen in FIG. 5. At least at one of its end portions said connector piece 40 includes an end portion 42 which has a general design which, in a direction which is transverse to the longitudinal direction of said connector piece 40, in the same manner corresponds to a stud's bottom groove, in this case the bottom groove in the other stud 30 which will be connected transversely in relation to said first stud 20. Favorably, both studs 20 and 30 are identical, and then said connector piece 40 also at its end will have a profile which at least at edges 44 correspond, to essential portions, to the profile in section A-A. Suitably this profile is manufactured by cutting out an edge portion 43 at one end 42 of a connector piece, at a distance from the outermost end thereof, which connector piece has a profile which generally at edges 45 is rounded or in some other manner provided with a profile which corresponds to the bottom groove profile of the studs. Said edge portion 43 generally corresponds to the flange profile of said stud 30, and in a corresponding manner the outermost edges 44 of the profile are bevelled to correspond to the cross section of said additional grooves 12, 12*a*. In some embodiments said bevellings are made slightly coarsely so that the end profile of the connector piece 40 will have a slightly snug fitting to the transversal stud's 30 groove 12 and inner flange sides 6, respectively.

Using the above described arrangement an attachment of a vertical stud 20 can now be performed practically anywhere along a horizontal stud 30, which, for example, can be attached to a ceiling 31, as disclosed in FIG. 5, to a floor (not shown) or which constitutes a terminating horizontal edge stud or the like without any separate connection to any existing surface. The installation of a vertical stud 20 against a horizontal stud 30 is favorably effected so that said body portion 41 of said connector piece 40 is pushed in to such an extent into the vertical stud's 20 bottom groove defined by said additional grooves 12, 12*a* that one end 42 of said connector piece 40 extends outwards in level with a corresponding bottom groove in said horizontal stud 30. In FIG. 5 this vertical displacement is indicated with a double-end arrow. Depending on fitting tolerances due to the selection of material this vertical displacement can be arranged to be very light, in which case the arrangement favorably is supplemented with a certain artificial brake effect in order to prevent the connector piece from falling down in the vertical stud's bottom groove. Alternatively, this fitting is inherently arranged to be so tight that the displacement in the bottom groove will need, as such, a certain force.

At the installation between upper and lower horizontal studs the arrangement is suitably identical at both ends of the vertical stud 20. After this the vertical stud 20, which suitably has been cut off to have a slight clearance "a" against said horizontal studs 30, see FIG. 5, in inserted towards the respective horizontal stud in such a manner that said end 42 of the respective connector piece 40 is introduced into the bottom groove of the horizontal stud 30. Thereafter the vertical stud 20, including the introduced connector piece 40, is turned to the stud's final position, which in FIG. 5 has been indicated by an arcuate arrow. At the turning the upper end 42 of said connector piece 40 will suitably be slightly deformed especially against said retaining edge 14 and thus a tight fit is achieved. Alternatively, the connector piece 40 can be formed of some slightly harder material, for example of a harder sort of wood or a suitable plastics, so that the deformation will take place in said retaining edge 14, or suitably both at said retaining edge 14 and at the upper portion 42 of the connector piece 40. In a connector piece 40 manufactured of, e.g., plastics also the connector piece itself can comprise resilient elements (not shown) which finish the adaptation between connector piece 40 and stud 20, 30.

An alternative installation method includes the feature that the connector piece 40 is more or less fully inserted into the bottom groove of the vertical stud 20, and it is driven into the bottom groove of the horizontal stud 30 by means of, e.g., a hammer. In both cases the retaining edges 14, 14*a* will favorably act as a bead which prevents an unintentional detachment of the vertical stud. If wished, however, the stud can usually be detached by turning it out of the locking position.

If one wishes to further fix the stud this can be done for wooden studs by means of, e.g., nailing, gluing or the like, but normally such a fixation can be considered as superfluous, since a good strength is achieved already by an installation as described above. In spite of this, an installed stud can easily, e.g., by means of kicking be displaced laterally, which during the installation facilitates an adaptation to, e.g., board widths of standard measures. The final length of the studs is determined on the installation site and then an adaptation to, for example, an uneven underlying structure renders no problems. Since the connection between vertical stud and horizontal stud usually exploits whole of the contact surface which is formed by the end portion or head 42 of the connector piece 40 and the contact between the bevelled edges 43 and the flanges 5 of the horizontal stud the attachment is very strong. In spite of the fact that the installation normally can be performed without any other means than normal carpenter's hand tools and without any extra scaffolding nor the like means the attachment is so strong that the stud cannot fall, and thus no domino effect or the like can arise. The arrangement functions usually even so good also if some of said studs 20, 30 would have openings for some reason, since the contact surface between the stud 20, 30 and the connector piece 40 is large.

Figure 7:
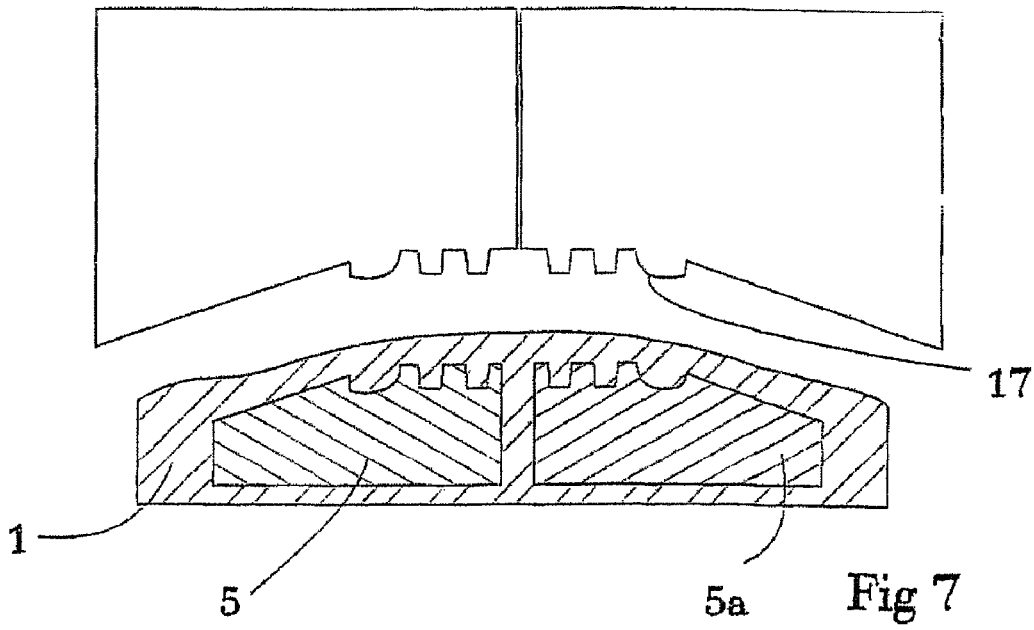
Figure 8:
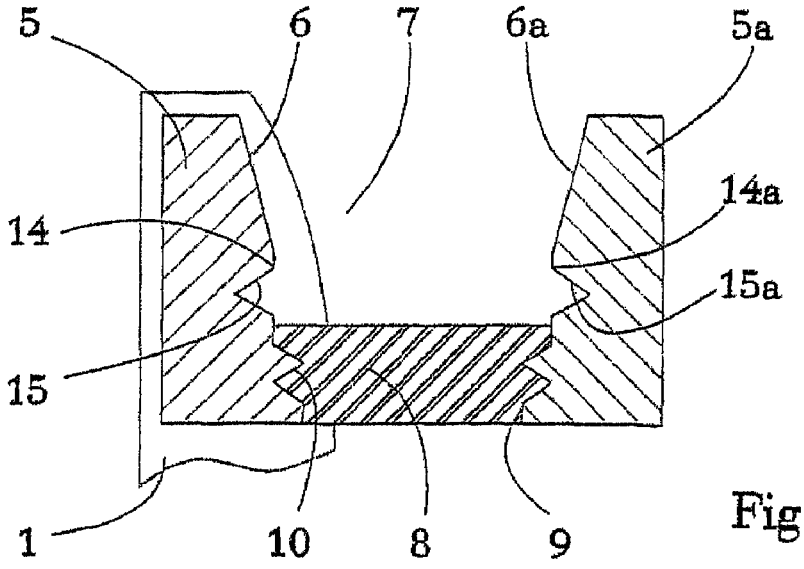

FIGS. 7 and 8 disclose how the flanges 5, 5*a* at a stud in accordance with the present invention can be formed from a wane edge timber block 1, e.g., by planing, mill cutting or in a corresponding manner. For this purpose the tool is favorably provided with a suitable profile 17 in order to form, on one hand, said additional groove 12 and, on the other hand, tongues and grooves or the like for the contact surface between the stud's flanges 5, 5*a* and web 8. In some embodiments, see for example FIGS. 9*b*, 10*b* and 11, the studs ar formed without any intermediate web between said flanges 5, 5*a*, in which case the embodiment according to FIGS. 9*a* and 9*b* utilizes identical flange profiles which can either be attached directly to each other or to an intermediate web. A corresponding arrangement is disclosed in FIGS. 10*a* and 10*b* which in a general manner disclose profiles having a so-called I-section, i.e. a cross section which corresponds to U-profiles arranged with the backs against each other.

Figure 11:
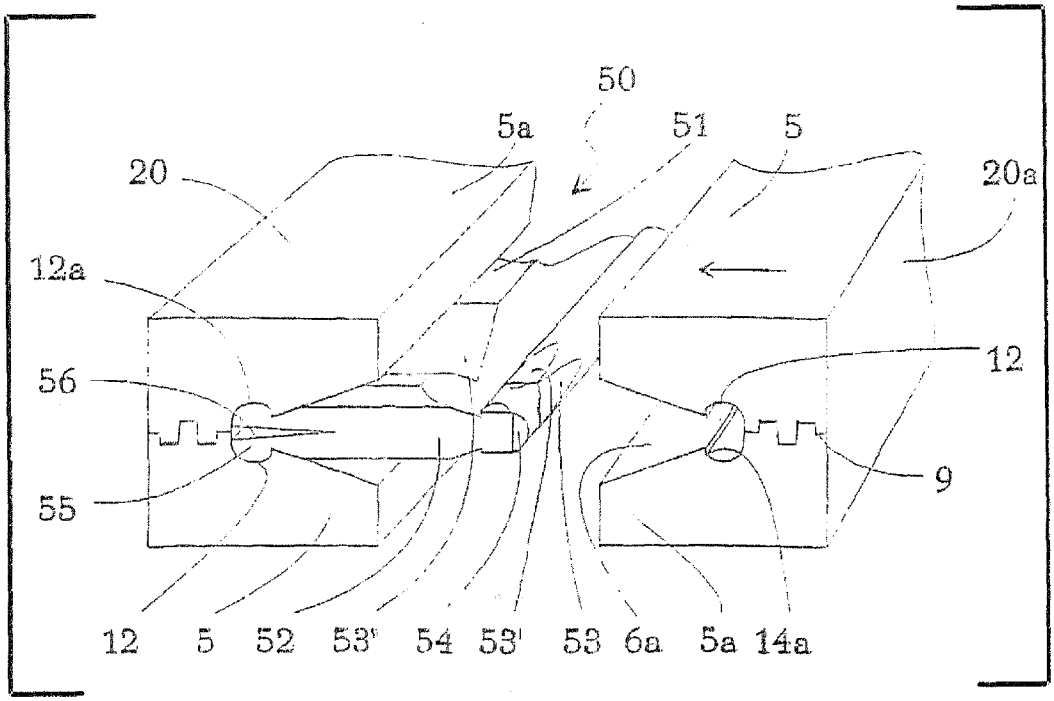

FIG. 11, in turn, discloses an arrangement where two stud profiles in accordance with the present invention are interconnected in a parallel manner under utilization of a common additional groove 12, 12*a* and a connector piece having another shape than the ones discussed earlier. Also in this connector piece 50 edges 45 include a profiling which in the longitudinal direction corresponds to grooves 12, 12*a* in a first stud 20. Said connector piece 50, however, also includes an opposite portion 51 having the same or another shape, and this portion 51 is arranged with respect to its shape to co-operate with a second stud 20*a* which is arranged in parallel with said first stud. By means of such a connector piece said studs 20 and 20*a* can be interconnected, e.g., by pressing, into a parallel disposition, which in FIG. 11 is indicate by an arrow. In order to facilitate this one or both edges 45 of the connector piece 50 can include a slit 55 which to a slight extent permits a compression of said edge 45 in order to facilitate the introduction behind the retaining edge 14, 14 at the groove 12, 12*a*. An alternative attachment method (not shown) includes the introduction of connector pieces 50 in the longitudinal direction.

FIG. 11 further discloses that also a connector piece 50 having this design can be designed, at the end thereof, in turn to co-operate with a transversal stud (not shown) in accordance with the principles which have been discussed above for said connector piece 40. According to a favorable design of studs 20, 20*a*, 30 and connector pieces 40, 50 one and the same connector piece profile, or favorably one and the same connector piece, can be used for all the attachments discussed above. For the connector piece 50 disclosed in FIG. 11 this has been generally indicated so that an end portion 52 of said connector piece 50 has been shaped so that it besides the connecting function in the direction illustrated by the studs 20, 20*a* to its shape also in two further directions can be attached at said end 52 to a transverse stud. For this purpose said end 52 of said connector piece 50 includes notches 53, 53', 53" and beveled portions 54, 54', 54" which between themselves are arranged in an angular disposition for co-operation with said grooves 12, 12*a* and, respectively, with corresponding flange inner sides 6, 6*a* at mutually transverse studs. By means of such a connector piece transverse connections can freely be arranged between studs having a broad bottom groove, see for example FIG. 9*a*, or a narrow bottom groove, see corresponding FIG. 9*b*.

Finally, FIGS. 12 and 13 disclose alternative connector piece profiles so that FIG. 12 discloses a profile for a favorable connector piece 60 made of plastics and including an additional tongue 61 for the attachment of external details such as electrical boxes or the like. Such a connector profile 60 is favorably open so that it in cross section only includes two opposite generally C-shaped tongues 62 which generally correspond to the profile of said groove 12, 12*a*, which tongues are interconnected by an intermediate bottom portion 65 which is thin in relation to the groove's lateral extent. Such profiles can easily be made slightly elastic so that a certain nesting capacity can be achieved. Connector pieces having such a general cross sectional design can also include a separate shaped piece (not shown) at the locking end of the connector piece, which shaped piece facilitates the connection to a transverse stud as discussed above and which effectively secures a locking between the studs. FIG. 13 discloses, in section, another connector piece 60 which in an essentially massive manner extends both in said bottom groove formed by said additional grooves 12, 12*a* and to an essential degree also in the first groove 7 which is formed between said flanges 5, 5*a*. Such a connector piece 60 is especially suitable for attaching for example door frames or the like to a respective stud.

Although such embodiments have been discussed above, where the respective studs have been manufactured of wood and favorably of a waste wood material it is clear that the present invention can be applied also for corresponding studs which are manufactured of full edge wood or, respectively, of some other material where the goods thickness in the stud flanges cannot be disregarded. The present invention also finds applicability in studs which are manufactured as a combined utilization of different materials, such as wood and metal or wood and cardboard or studs having a web made of, e.g., plywood. It is also clear that though above has mainly been discussed the attachment of vertical studs to horizontal studs a corresponding arrangement can also be utilized for attaching horizontal studs or stud portions, supports etc. to vertical studs.

The invention claimed is:

1. A stud system comprising a plurality of individual structural studs, said individual structural studs including respective opposite mating flanges and a longitudinal groove between said respective opposite mating flanges, said opposite mating flanges of said individual structural studs including opposing inner flange sides, and said opposing inner flange sides of said individual structural studs including opposing additional longitudinal grooves extending in the longitudinal axis of the individual structural stud, wherein said system includes separate connector pieces for mutually interconnecting said individual structural studs, wherein each respective separate connector piece is arranged to co-operate with the opposing additional longitudinal grooves of at least one individual structural stud, wherein the opposing additional longitudinal grooves are arranged to prevent said separate connector piece from moving in a direction away from said individual structural stud transverse to the longitudinal axis of said individual structural stud, wherein said longitudinal groove forms a retaining edge defined at a location wherein said at least one groove abuts an inner side of a corresponding respective opposite flange, and wherein the system includes further pieces for attachment of external details, said further pieces being arranged to co-operate with said longitudinal groove and to be retained therein, suitably behind said retaining edge.

2. A stud system as defined in claim 1, wherein said further pieces are generally U-shaped slightly resilient elements.

3. A stud system as defined in claim 1, wherein said further pieces include attachment points for screws, rivets or corresponding attachment means for attaching boxes, cables or other external details.

4. The stud system as defined in claim 1, wherein at least one end of said connector piece is shaped to lockingly engage said additional longitudinal groove of a stud transverse to a longitudinal axis of said connector piece.

* * * * *